US005484305A

United States Patent [19]

Diniz et al.

[11] Patent Number: 5,484,305

[45] Date of Patent: Jan. 16, 1996

[54] MICRO-CONNECTOR AND AUTOMATED TOOL FOR APPLICATION THEREOF

[75] Inventors: Milton E. Diniz; Vagner Fuzetti, both of Braganca Paulista, Brazil

[73] Assignee: The Whitaker Corporation, Wilmington, Del.

[21] Appl. No.: 277,467

[22] Filed: Jul. 20, 1994

[30] Foreign Application Priority Data

Jul. 28, 1993 [BR] Brazil ..... 9303027

[51] Int. Cl.[6] ..... H01R 4/44

[52] U.S. Cl. ..... 439/421; 174/84 C

[58] Field of Search ..... 439/421–424, 439/430, 877, 402, 406

[56] References Cited

U.S. PATENT DOCUMENTS

| | | | |
|---|---|---|---|
| 2,783,447 | 2/1957 | Watts | 439/423 |
| 3,287,790 | 11/1966 | Fritz et al. | 29/33.5 |
| 3,320,354 | 5/1967 | Marley et al. | 174/84 |
| 3,410,950 | 11/1968 | Freudenberg | 439/423 |
| 3,436,820 | 4/1969 | Reem et al. | 29/628 |
| 3,444,312 | 5/1969 | Over | 439/421 |
| 3,611,262 | 10/1971 | Marley et al. . | |
| 3,760,331 | 9/1973 | Gurley . | |
| 3,826,861 | 7/1974 | Karl et al. | 439/424 |
| 3,902,004 | 8/1975 | Harding et al. | 439/424 |
| 4,127,312 | 11/1978 | Fleischhacker et al. . | |
| 4,464,541 | 8/1984 | Ceresa et al. | 174/84 C |
| 4,552,429 | 11/1985 | van Alst . | |
| 4,714,801 | 12/1987 | Koblitz et al. | 174/88 R |
| 4,806,120 | 2/1989 | Baker | 439/399 |
| 5,110,387 | 5/1992 | Jasinski et al. | 156/222 |

FOREIGN PATENT DOCUMENTS

| | | | |
|---|---|---|---|
| 0508837 | 6/1973 | U.S.S.R. | 439/424 |
| 1180090 | 2/1970 | United Kingdom | 439/421 |

*Primary Examiner*—David L. Pirlot
*Assistant Examiner*—Jill Demello
*Attorney, Agent, or Firm*—Timothy J. Aberle

[57] ABSTRACT

The present invention includes an electrical connector manufactured in the form of a strip of Micro-connectors stamped from an integral piece having a parallelepipedical body (4) in the shape of a "U" having a bottom portion (5) and two sidewalls capable of being inwardly crimped. The bottom portion (5) is centrally hollowed out and has in the inner ends thereof two sets of small metallic tongues (6, 7, 8) that are spaced apart from each other by contact slots (9, 10) of different sizes. The sidewalls include a positioner rod (11A, 11B) located adjacent to the two legs (16, 17) located on the ends thereof, each of the legs (16, 17) having two cutouts (12, 13, 14, 15) in the shape of a "V." The automated tool for application of the micro-connectors, is unique in that it applies reduced sized connectors. The tool has a wire cut system which cuts the wires on the side ends of the crimper (35) of the application tool (31) so that the wires are arranged side by side after cutting. The tool, additionally, has a wire positioning system which permits the application of micro-connectors in both tapping and splicing situations.

10 Claims, 9 Drawing Sheets

(PRIOR ART) FIG. 10

Fig. 13
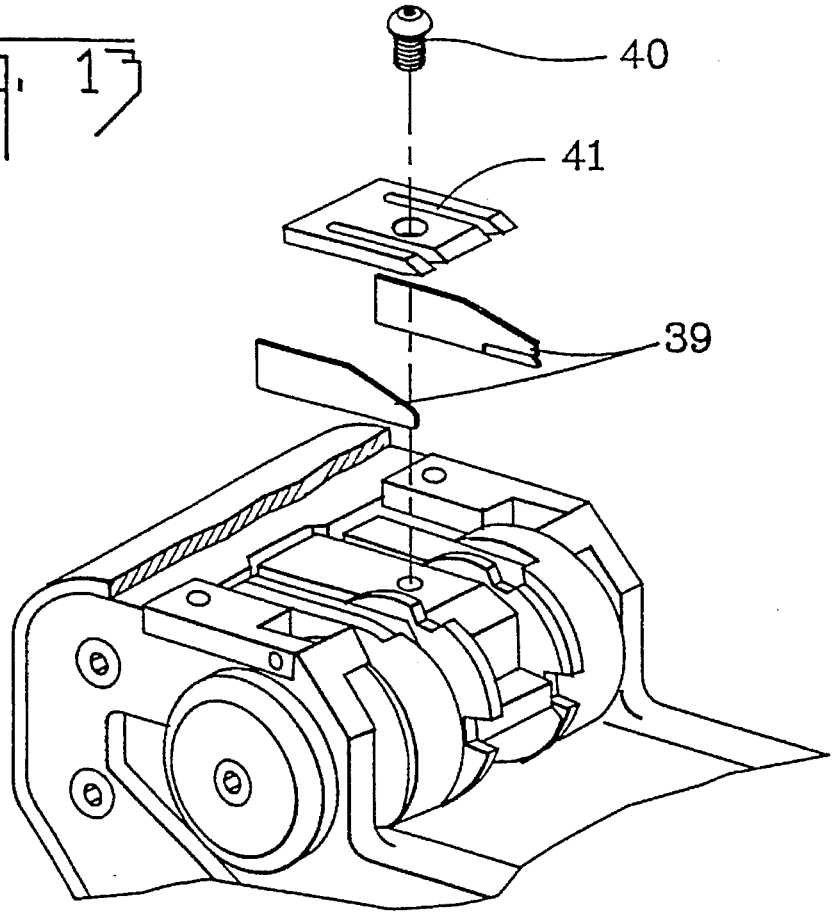
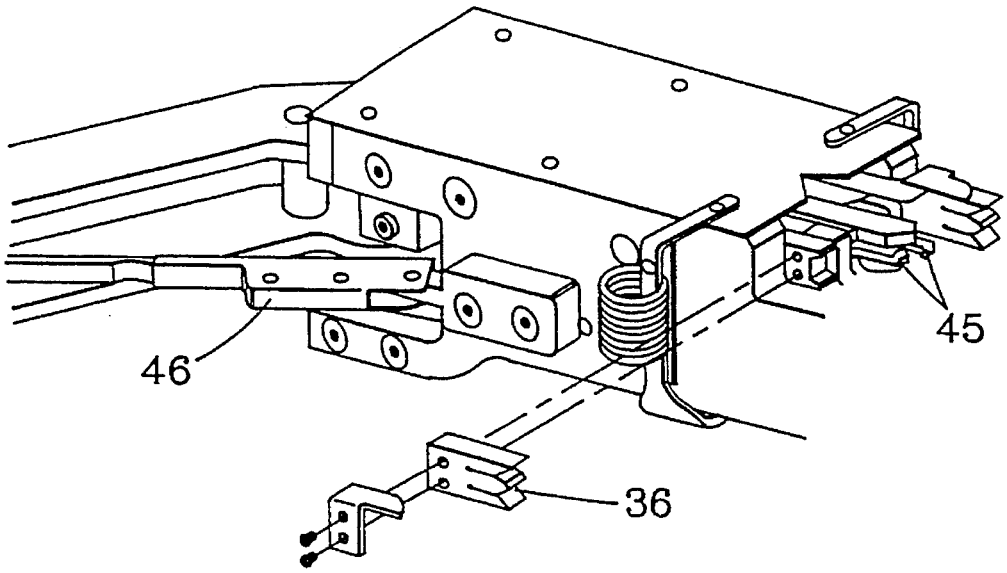
Fig. 14

MICRO-CONNECTOR AND AUTOMATED TOOL FOR APPLICATION THEREOF

FIELD OF THE INVENTION

The present invention relates to electrical connecting devices employed in the splicing of multiconductor telephone cables comprised of electrical conductors of different or same gauge using only one type of connector, and to automated tools for applying the connecting device. More specifically, the present invention relates to a type of connector for splicing multiconductor telephone cables which requires a specific application tool, to crimp the connector.

DESCRIPTION OF PRIOR ART

In splicing telephone cables, the cable ends are arranged to each other and the individual wires in the cables are spliced by the operator or lineman. When the ends of two pairs of wires are being connected to each other, it is necessary to make two separate electrical connections, i.e., to connect each corresponding end of the wires of the two pairs.

In accordance with prior art practice, when the ends of a severed telephone cable are being spliced, the lineman first separates from the numerous pairs in each end the particular pairs which are to be connected. He then separates the two wires in each of the pairs and makes electrical connections between the ends of these wires. After making the connections for these pairs, he can then proceed to a next two pair of wires in the cable and make the electrical connections for it.

In order to facilitate the electrical connections between wires of two pairs, as described above, several connecting systems were developed in which the technician can separate and identify the ends of two pairs of wires. He can then splice the ends of the wires using a specific device and an application tool.

Such connectors for splicing telephone cables are already known. However, the connectors commercially available have certain drawbacks, such as size, the amount of wires used by the same connector and the size of the final splice of the multiconductor telephone cables.

Accordingly, it is desirable to develop a new connector for splicing multiconductor telephone cables which has reduced size in relation to the known connectors, and which can cover a wide range of wire gauges for the same connector. In addition, it covers all combinations of application of cables for connectors of prior art and further which reduces the size of the final disadvantages presented by the connectors of prior art.

Automatic tools for application of connectors of the prior art are usually of the type having a slot which extends transversely between its ends. The wires which should be spliced are generally positioned in the slot of the tool and then centrally cut. Further, the automatic application tool positions the wires in the connector to be used and then crimps inwardly the legs of said connector, thus accomplishing the crimping of the connector.

Since the application tools of the prior art cut the wires centrally, they do not permit the use of connectors of reduced sizes. Consequently, such application tools can not be designed to be of the compact type, being heavy and of high manufacture cost.

Further, according to the connector application tools of prior art, when it is desirable to make a straight splice of telephone wires and a tapping splice, it is necessary to use two application tools, since the application tools of the prior art make only straight splices or tapping splices, i.e., an application tool of prior art does not make the two types of splice using the same tool.

Thus, it is desirable to develop a tool for application of connectors of the automatic type, appropriate to be used with connectors of reduced size, such as the micro-connector of the present invention, such a tool being compact, light and of low manufacture cost, thus overcoming the disadvantages presented by the automatic tools for application of connectors of the prior art.

SUMMARY OF THE INVENTION

The invention provides a connector device designed to join 19–26 AWG copper telephone cables with PVC or paper insulation of the aerial or underground type, which uses only one type of connector comprised preferably of a copper alloy adhered to a polyester film, the metallic body of said connector being tin coated.

The micro-connector of the present invention has a reduced size, that is approximately half of the length of the connectors of the prior art and, in addition to this, it permits the use of a great amount of wire gauges for the connector, in the range of four wires with different gauges, while the connectors of prior art use at the most three wires of different gauges.

The micro-connector of the present invention is provided with two different slot sizes, which allow to cover all wire range indicated for this type of connector, no matter what is the range of the wire, since the smaller slots have an appropriate size to cover the smaller wire sizes and the bigger slots have another size to cover the bigger ones.

Further, the micro-connector of the present invention is a low cost connector which offers economical advantages in relation to the connectors of prior art.

The automatic tool of the present invention is for the application of micro-connectors, of the present invention, designed to join conductor wires using reeled micro-connectors. Such a tool provides uniform and high quality connections which meet all requirements of electrical conductivity, isolation, mechanical resistance and compaction.

The application tool of the present invention applies the micro-connectors to the wires by means of the crimping of the micro-connectors between a set of crimpers. The fixed die is called the anvil and the movable die is the crimper which crimps the wire in the connector.

Furthermore, the application tool has wire supports which position and hold wires in the crimpers and a wire cut system which cuts the wires by the ends arranging them side by side after the cut, which permits the use of said reduced size micro-connectors, the positioning of said micro-connectors being done by the sides of them in the feed knob of the application tool.

Further, the application tool of the present invention permits straight and tapping splices, which is also compact, light and of low manufacture cost.

BRIEF DESCRIPTION OF THE DRAWING

Additional features of the invention will become apparent and a fuller understanding will be obtained by reading the following detailed description made in connection with the accompanying drawings, wherein:

FIG. 13 is a perspective view showing in details the front portion of the application tool of the present invention; and FIG. 14 is a perspective view of the body of the application of the present invention showing the side portion of same taken from the right side of said tool of FIG. 11.

DETAILED DESCRIPTION OF THE PREFERRED EMBODIMENT

The micro-connector 1 which permits the splicing of telephone cables 2A, 2B and 2C of the present invention is preferably made of a copper alloy adhered to a strip 3 of polyester film, the body of said micro-connector being tin coated.

Figure 1:
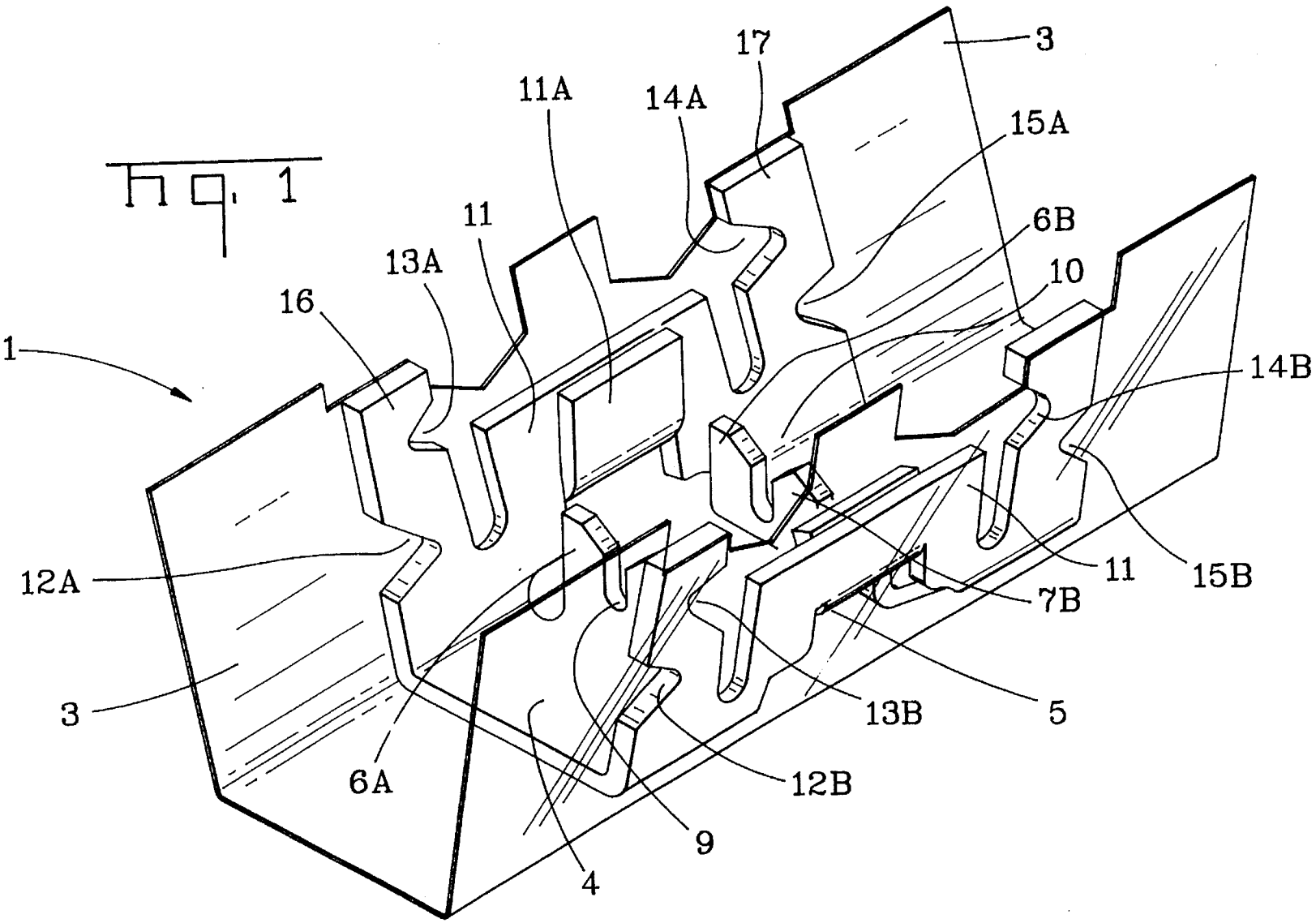
FIG. 1 is a perspective view showing frontal, top and right side portions of the micro-connector of the invention.
Figure 2:
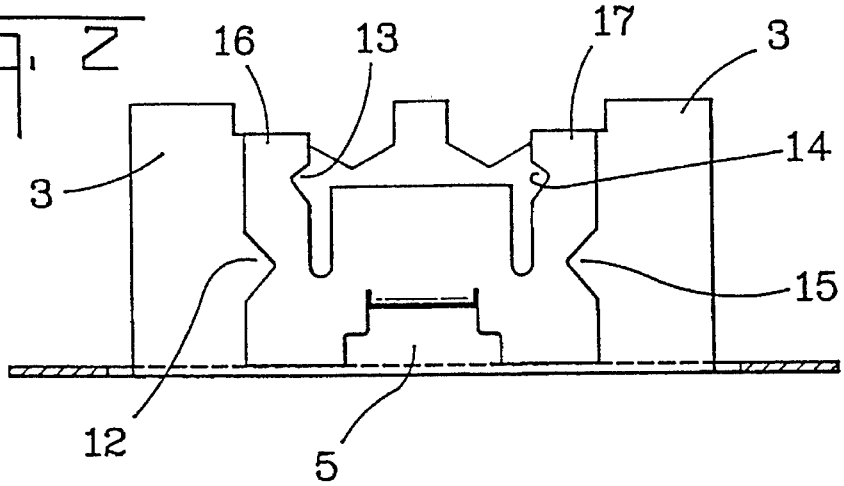
FIG. 2 shows a side view taken from the right side of the micro-connector of FIG. 1. The side view taken from the left side of the micro-connector of FIG. 1 was omitted, since it is identical to the one of FIG. 2.
Figure 3:
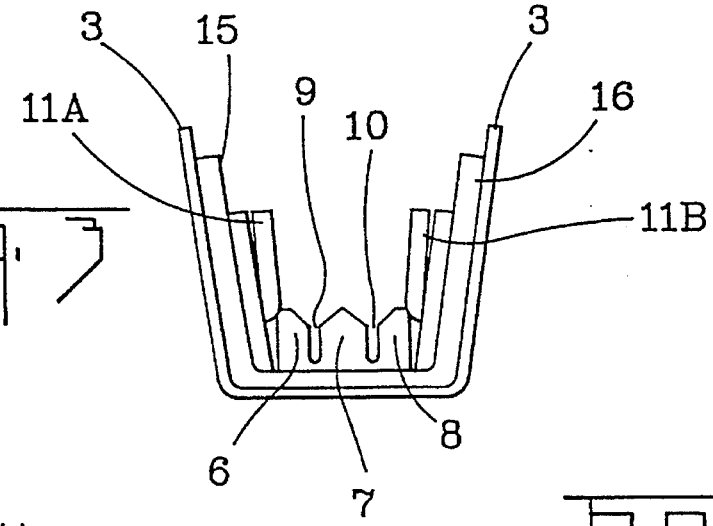
FIG. 3 is a front view of the micro-connector of present invention. The rear view of same was omitted, since it is identical to the one of FIG. 3.
Figure 4:
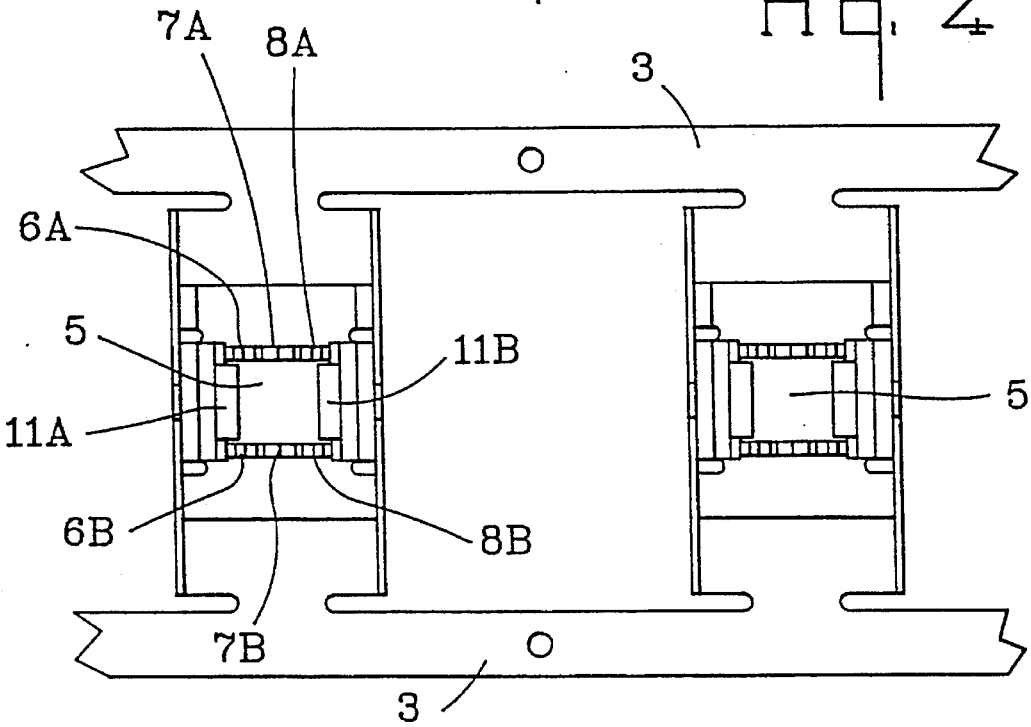
FIG. 4 is a top view showing a connector strip with two micro-connectors designed in accordance with the micro-connector of FIG. 1.
Figure 5:
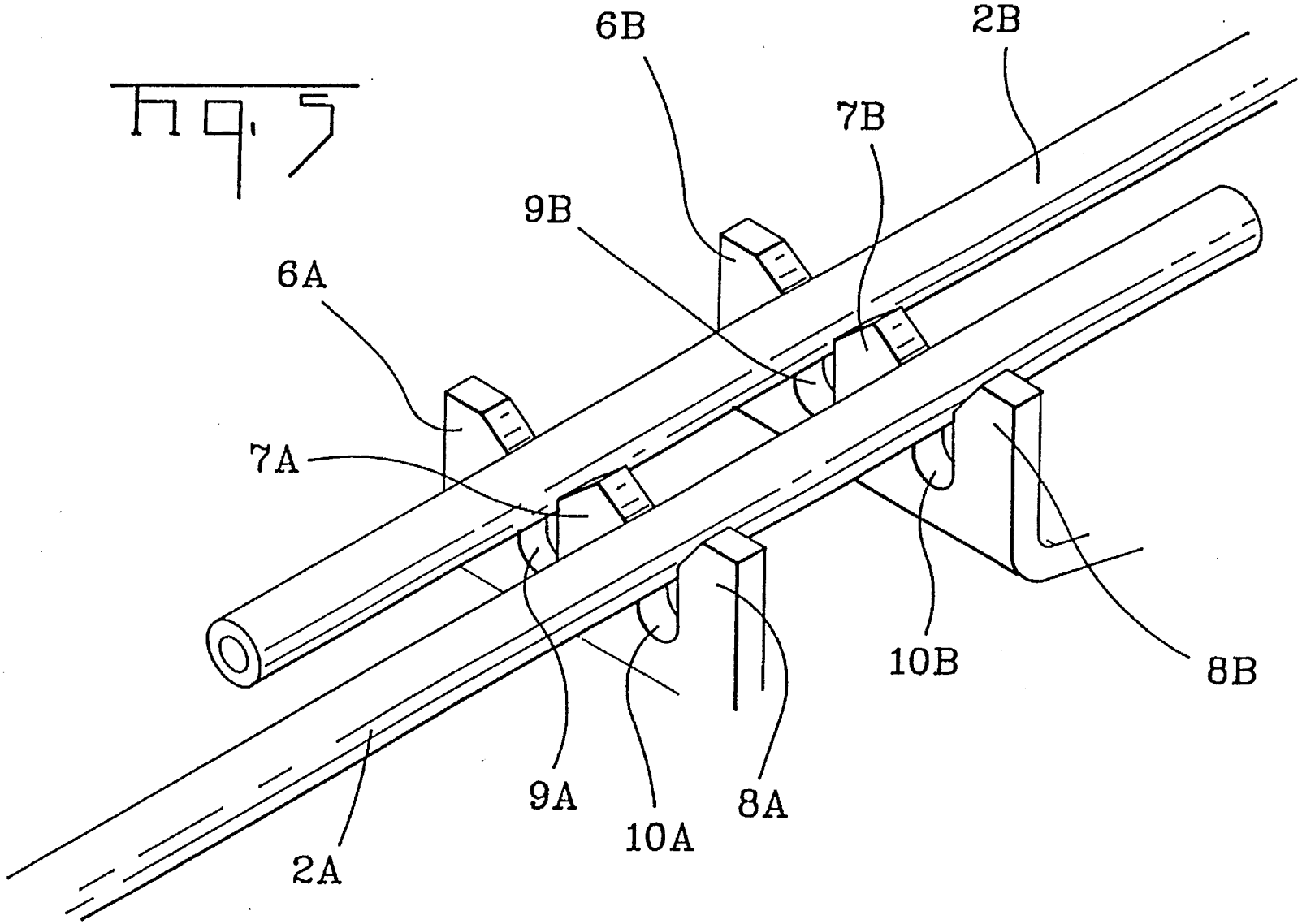
FIG. 5 is a perspective view showing in detail the slots of the micro-connector designed to receive the connecting wires.

The micro-connector 1 of the present invention, best shown in FIG. 1, is manufactured in an integral piece having a parallelepipedical body in the shape of a "U" 4, the bottom portion 5 of the said body in "U" being centrally hollow throughout and slightly narrower than the top portion of the micro-connector 1.

At the inner ends of the centrally hollowed out bottom portion of said micro-connector 1 there are three small metallic tongues 6, 7 and 8 in the shape of lances perpendicularly located in relation to the bottom portion of the body in "U" 4, three of them 6A, 7A and 8A being located at a first end of the hollow out portion 5 and the other three 6B, 7B and 8B being located at the other side of the hollow out end 5. Said metallic small tongues 6, 7 and 8 are spaced from each other by small contact slots 9, 10 which are designed to receive the telephone cables 2A, 2B, 2C. The smaller contact slots 9A and 10B are designed to receive smaller gauges of wire and the bigger ones 9B and 10A are designed to receive bigger gauges of wire. The most external metallic small tongues 6A, 6B, 8A and 8B have the same size and the central metallic small tongues 7A and 7B are similar in size but larger than the external metallic small tongues.

The micro-connector 1 of the present invention has a small positioner rod 11A, 11B in each inner side wall or back plate 11. The rods are located between legs 16 and 17 and their function is to position wires 2A, 2B, 2C inside of the contact slots 9, 10, which are to be connected.

The micro-connector 1 of the present invention further has cutouts in the shape of a "V" 12, 13, 14, 15, located at the ends of legs 16, 17 of the "U" of the body 4 of said micro-connector 1.

In order to perform the splicing of telephone cables using the micro-connector 1 of the present invention, it is necessary to use a specific hand actuated or automated tool, which will be described below, to apply wires 2A, 2B, 2C to be spliced which are positioned in said tool, which in its turn places wires 2A, 2B, 2C in the corresponding contact slots 9A, 9B and 10A, 10B. Then, the above mentioned application tool crimps inwardly the legs 16, 17 of the body in the shape of a "U" of connector 1 in order that the wires 2A, 2B, 2C to be spliced are urged into the contact slots 9A, 9B and 10A, 10B with the help of the positioner rods 11A, 11B. In this operation, when wires 2A, 2B, 2C are urged to enter in the contact slots 9A, 9B, 10A, 10B, the metallic small tongues 6, 7, 8 break through the insulator of the wire until touching the wire itself and accomplish the electrical connection.

Figure 6:
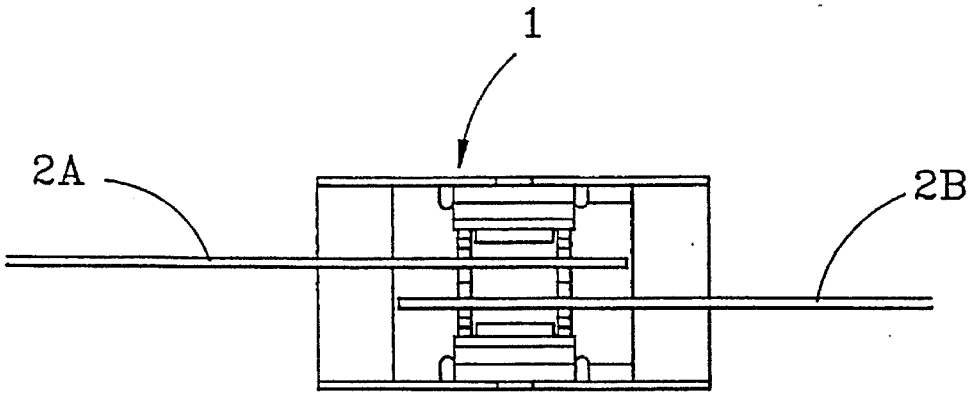
FIGS. 6, 7 and 8 are top views of the micro-connector of the present invention showing the possible connections for the same.
Figure 7:
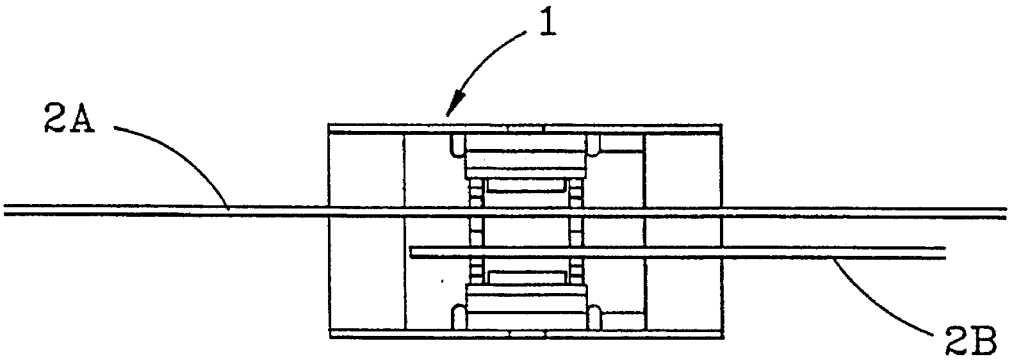
Figure 8:
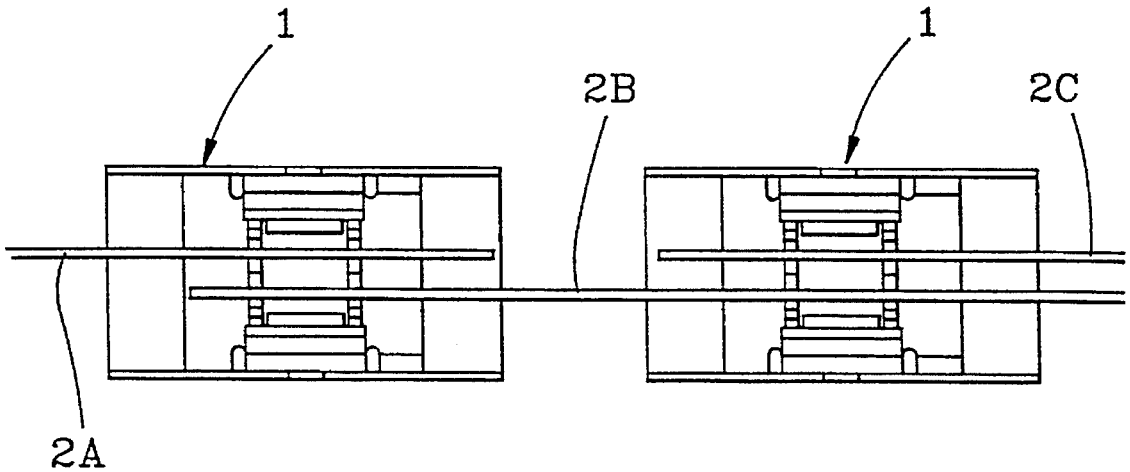

Accordingly, the same connector 1 can be used to make splices of wires of different gauges as illustrated in FIGS. 6, 7 and 8.

It will be noted that the present invention discloses a micro-connector, which splices telephone cables, that is of simple design but is effective and of low cost. The application of the connector is performed by means of an automatic tool 31 which will now be described in detail.

Figure 9:
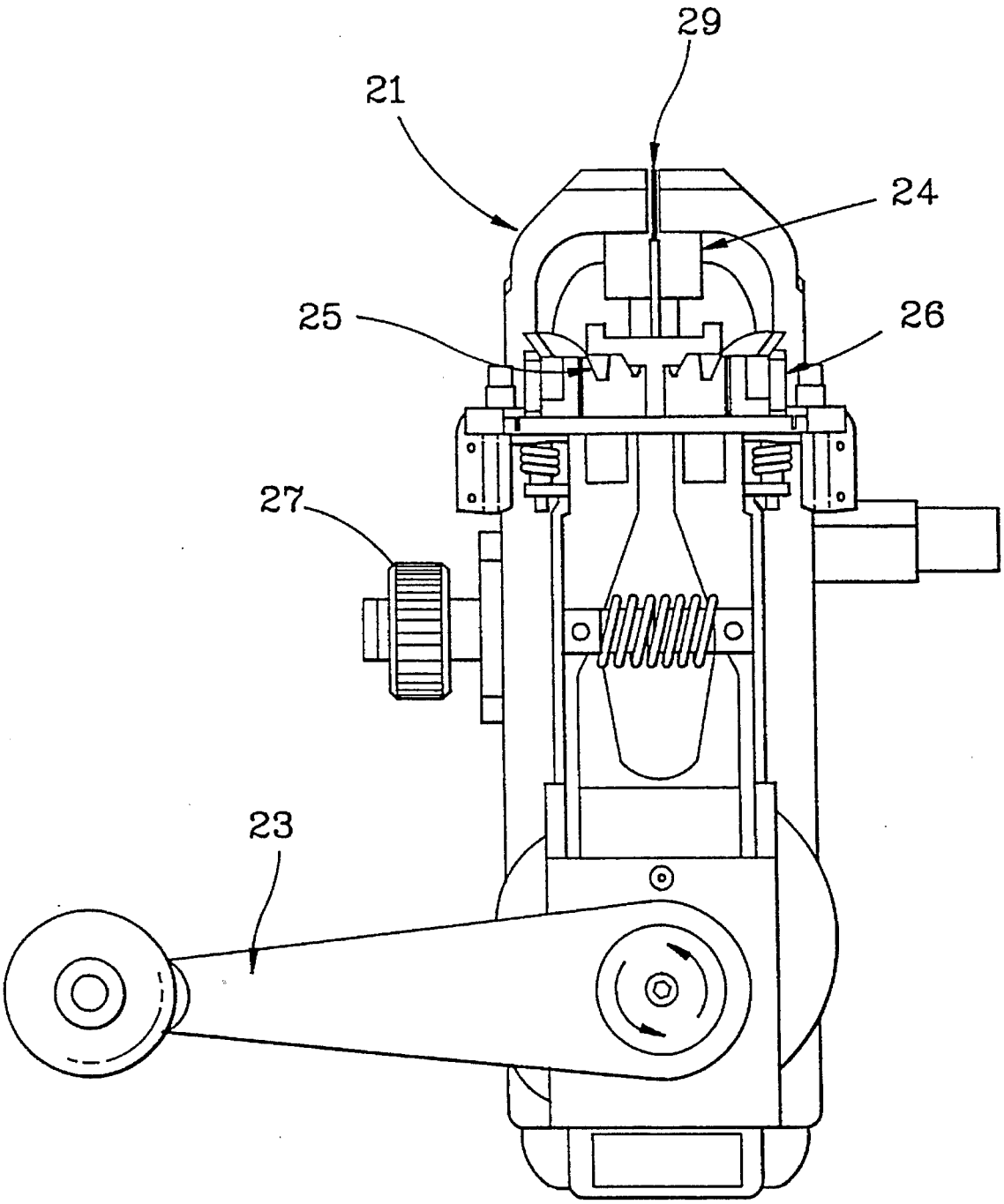
(PRIOR ART) FIG. 9
FIG. 9 is a top view of an automatic tool for application of connectors of the prior art.
Figure 10:
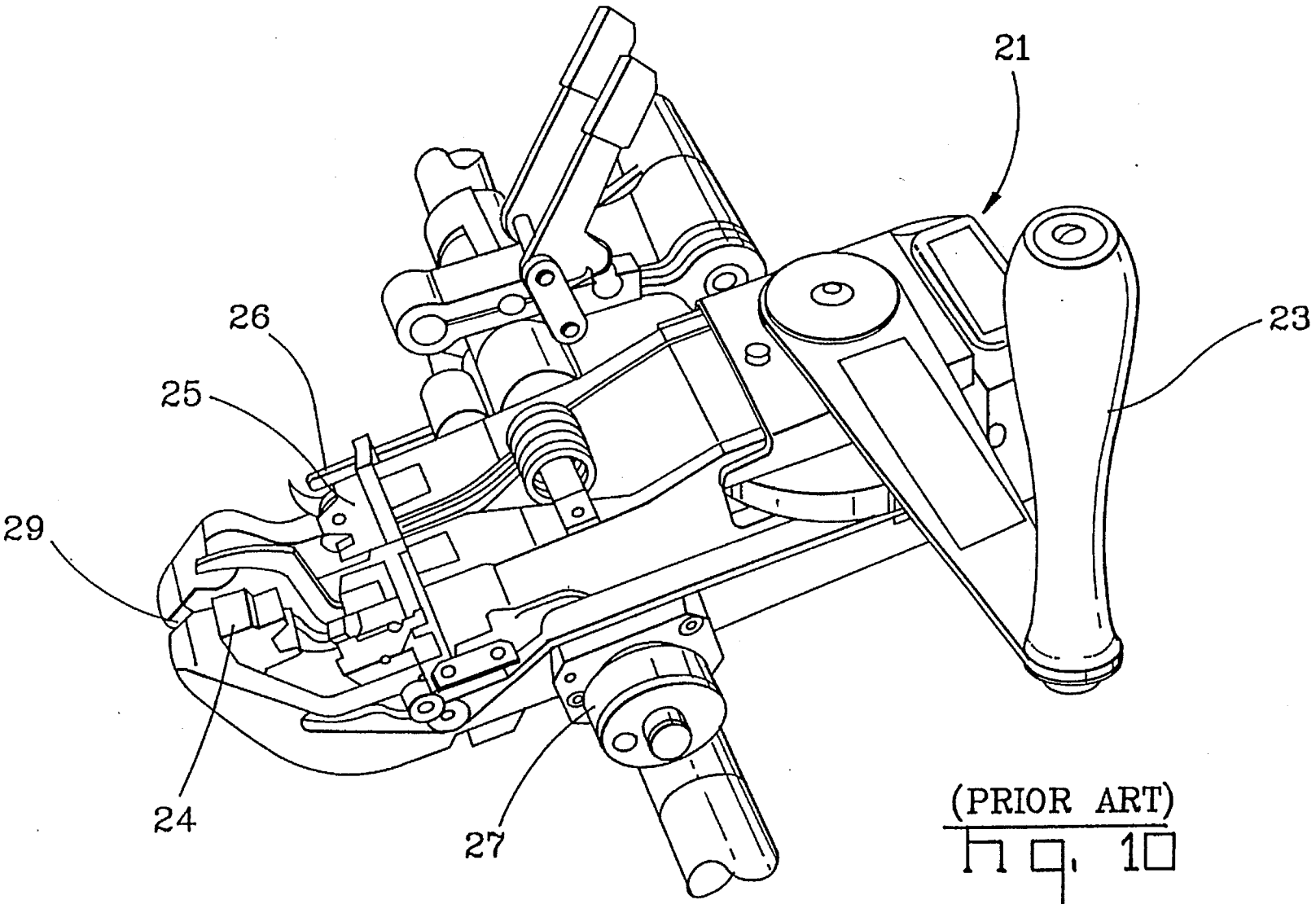
FIG. 10 is a perspective view showing the automatic tool for application of connectors of the prior art of FIG. 9.

An automatic tool 21 for application of connectors of the prior art is illustrated in FIGS. 9 and 10, and presents a central cut system 29, i.e., the wires are positioned in front of each other after cutting. Additionally, said tools present an angular movement of crimping of connectors and a pressing power system of connectors which uses a cam, that is, an operating handle 23 of 360 degrees of rotation on the other hand, the application tool 31 of the present invention is provided with a cut system which cuts by the ends 39, i.e., the wires are positioned side by side after the cutting. Furthermore, said tool 31 presents a horizontal movement of crimping of connectors 1, which are in the form of a micro-connector strip 32, and a pressing power system of micro-connectors which uses an operating lever 33.

Figure 11:
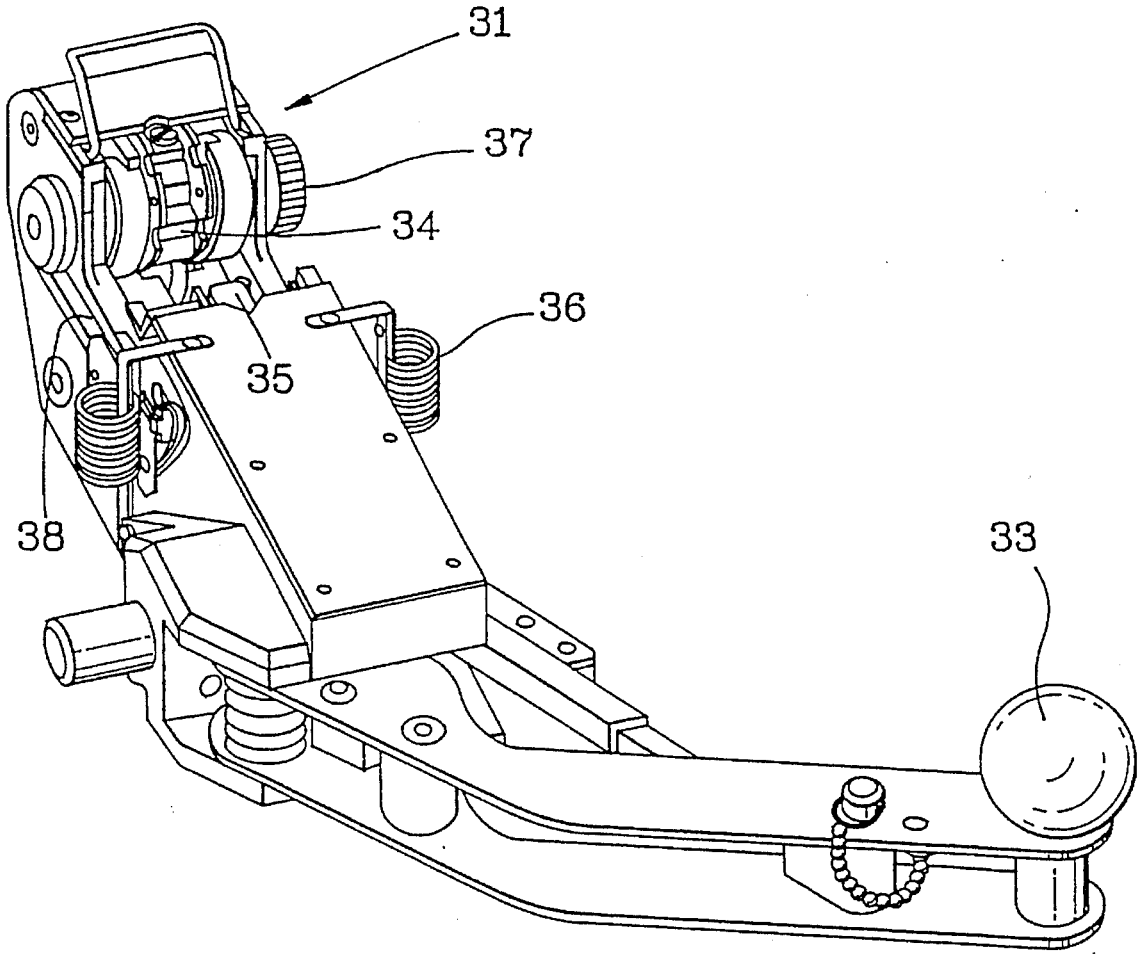
FIG. 11 is a perspective view showing an automatic tool for application of micro-connectors of the present invention.
Figure 12:
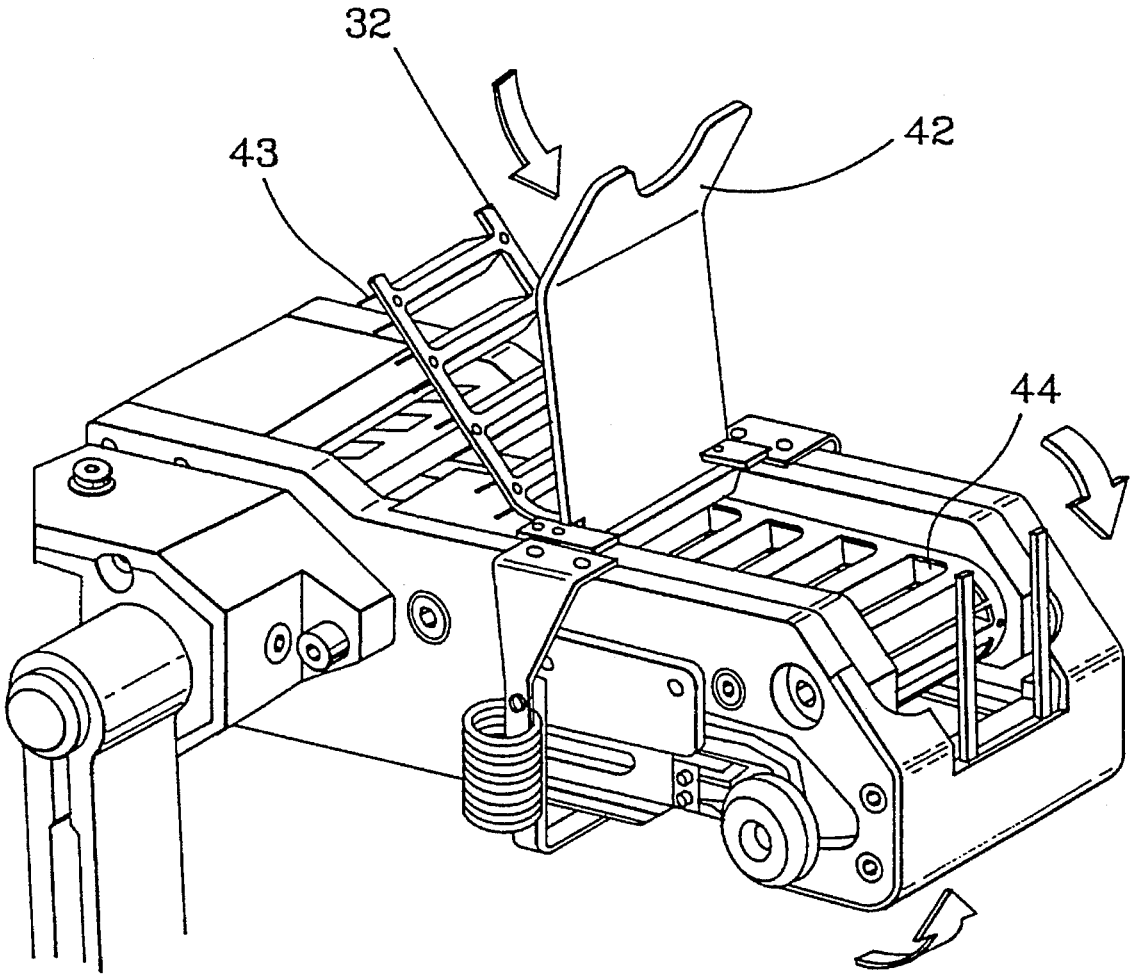
FIG. 12 is a perspective view showing the bottom portion of the automatic tool for application of micro-connectors of the present invention.

The automatic tool 31 for application of micro-connectors strip 32, of the present invention, best shown in FIG. 11, has an operating handle 33, one fixed die which is an anvil 34 and one movable die which is a crimper 35, wire supports 36 for the wires to be spliced, a feed knob 37 for feeding the reeled micro-connectors and a transport catch 38 to transport the strip of micro-connectors.

The operating handle, as its name indicates, operates the application tool 31. One complete forward and reverse motion is equal to one complete crimp cycle of a micro-connector. The operating handle 33, further has a spring which automatically returns the operating lever 33 to the starting position to crimp the next micro-connector of the strip of micro-connectors 32.

The anvil 34 and the crimper 35 crimp the micro-connectors, i.e., the application tool 31 applies the micro-connectors to the wires by crimping them between the anvil 34 and crimper 35.

The wire supports 36, located in the side ends of the application tool 31, position and hold the wires in the crimpers 34 and 35. Two cutting blades 45 to cut the wires are secured in the sides of the application tool, which cut the wire ends against the sides of the crimper 35 when it advances. Two blades 39 for cutting the micro-connectors 32 of the strip are secured by means of a screw 40 and a cover 41 in the anvil 34.

A feed knob 37, which can rotate clockwise or anti-clockwise, rotates a feed sprocket forward or backward in order that the micro-connectors strip 32 forward to start the application of micro-connectors or backwards to remove the strip of micro-connectors 32 of the application tool 31.

The application tool 31 of the present invention further has a transport catch 38 which automatically advances feed sprocket when the operating handle 33 is pushed backward.

In order to join the wires using a micro-connector strip 32 and the application tool 31 of the present invention is necessary, in first place, to insert micro-connector strip 32 in the application tool 31, as follows:

a) cut carrier strip 32 midway between two micro-connectors;

b) open protective cover 42 of application tool 31 and, with the open side of the micro-connectors 43 facing the application tool 31, start the connector strip into the guide channel of the application tool 31;

c) guide the micro-connector strip 32 over a guide channel, making the return through roller 44 and into the sprocket;

d) hold micro-connector strip 32 in the right position and rotate feed knob 37 slowly until certain that micro-connector strip 32 is started in the application tool 31; and e) rotate feed knob 37 until the third micro-connector is aligned on the anvil 34 of the application tool 31 and the carrier strip exists in the exit end of the application tool 31.

In joining telephone cables, using the application tool 31 of the present invention with the micro-connector strip 32 already inserted in the application tool 31, it is necessary to centralize the application tool 31 in relation to the telephone cables in a way that the splices are not loose or decentralized. After that, take a wire from the right side of the application tool 31 and lace it through the wire support 7 and out between the crimpers 34, 35. Then, take a second wire from the other side of the application tool 31 and lace it through the other wire support 36 and out between the crimpers 34, 35. Finally, cycle the application tool 31 by pushing the operating handle 33 forward until bottomed and then allow it to return freely. Next, repeat the above steps for the other pair of wires.

Accordingly, the automatic tool for application of micro-connectors 1 can be used for splicing telephone cables using micro-connectors strip.

Although the invention has been shown and described with respect to a best mode embodiment thereof, it should be understood by those skilled in the art that the foregoing and various other changes, omissions and additions in the form and detail thereof may be made therein without departing from the spirit and scope of the invention as claimed in the appended claims.

We claim:

1. An electrical connector with a body member having a bottom portion with electrical terminals and a pair of crimpable wall portions extending therefrom, said walls define a generally U-shaped cross-section of said body member, said electrical connector comprising:

at least a pair of deflectable legs formed on opposed sides of said body member on respective walls thereof, said deflectable legs are adapted for crimpable engagement with wires to be terminated in said electrical terminals, and at least one of said deflectable legs comprises a pair of cut-outs for facilitating deformation of said at least one deflectable leg; and a rod member formed on each of said respective walls adjacent to a respective one of said deflectable legs, each said rod member is adapted for engaging and stuffing said wires into said electrical terminals.

2. The electrical connector of claim 1, wherein said rod members are each formed on a respective backing plate, said backing plates comprise respective flat plate sections adjacent to respective top-most edges formed on said rod members.

3. The electrical connector of claim 1, wherein at least one of said rod members is formed on a respective backing plate, said backing plate comprises a respective flat plate section adjacent to a respective top-most edge of its respective said rod member.

4. The electrical connector of claim 1, wherein at least one of said rod members is formed on a respective backing plate, said backing plate comprises a top-most plate section, and said top-most plate section is generally planar.

5. The electrical connector of claim 1, wherein said pair of cut-outs for facilitating deformation of the leg comprise generally V-shaped notches.

6. The electrical connector of claim 1, wherein said pair of cut-outs for facilitating deformation of the leg comprise notches formed in said one leg.

7. An electrical connector with a body member having a bottom portion with electrical terminals and a pair of crimpable wall portions extending therefrom, said walls define a generally U-shaped cross-section of said body member, said electrical connector comprising:

at least a pair of deflectable legs formed on opposed sides of said body member on respective walls thereof, said deflectable legs are adapted for crimpable engagement with wires to be terminated in said electrical terminals; and a rod member formed on each of said respective walls adjacent to a respective one of said deflectable legs, each said rod member is adapted for engaging and stuffing said wires into said electrical terminals, at least one of said rod members is formed on a respective backing plate, and said backing plate comprises a respective flat plate section which is formed generally flush with a respective said wall portion and is adjacent to a respective top-most edge of said at least one rod member.

8. The electrical connector of claim 7, wherein at least one of said deflectable legs comprises a pair of cut-outs for facilitating deformation of said one leg.

9. The electrical connector of claim 8, wherein said pair of cut-outs for facilitating deformation of the leg comprise generally V-shaped notches.

10. The electrical connector of claim 8, wherein said pair of cut-outs for facilitating deformation of the leg comprise notches formed in said one leg.

* * * * *